United States Patent [19]

Sando et al.

[11] Patent Number: 4,517,818

[45] Date of Patent: May 21, 1985

[54] HIGH PRESSURE STEAMER FOR CONTINUOUS WET-HEAT TREATMENT OF A CLOTH

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 522,250

[22] Filed: Aug. 9, 1983

[30] Foreign Application Priority Data

| | | | |
|---|---|---|---|
| Aug. 9, 1982 | [JP] | Japan | 57-138277 |
| Aug. 9, 1982 | [JP] | Japan | 57-123278 |
| Aug. 9, 1982 | [JP] | Japan | 57-138279 |
| Nov. 17, 1982 | [JP] | Japan | 57-201391 |

[51] Int. Cl.[3] ..... D06B 3/12; D06B 23/22

[52] U.S. Cl. ..... 68/5 E; 68/18 F; 68/207

[58] Field of Search ..... 68/5 D, 5 E, 15, 18 F, 68/207

[56] References Cited

U.S. PATENT DOCUMENTS 4,055,971 11/1977 Hermes ..... 68/18 F X 4,182,141 1/1980 Sando et al. ..... 68/5 E

FOREIGN PATENT DOCUMENTS 2063943 6/1981 United Kingdom ..... 68/5 E

*Primary Examiner*—Philip R. Coe

*Attorney, Agent, or Firm*—Wenderoth, Lind & Ponack

[57] ABSTRACT

A high pressure steamer for continuous wet-heat treatment of a cloth has an inlet and an outlet for taking a cloth continuously in and out of the steamer body. The cloth inlet has an inlet side seal mechanism provided with a liquid seal tank and the cloth outlet has an outlet side seal mechanism provided with a slow cooling tank. A plurality of liquid application tanks and prewashing tanks are provided in the steamer for boiling the cloth passing through the steamer intermittently and repeatedly. A filter is provided for cleansing waste water exhausted from the slow cooling tank. A heat exchanger is provided for heating cleansed water by the use of high temperature waste liquor from the prewashing tank, and conduits supply the heated water to the liquid application tanks and prewashing tanks.

3 Claims, 4 Drawing Figures

HIGH PRESSURE STEAMER FOR CONTINUOUS WET-HEAT TREATMENT OF A CLOTH

BACKGROUND OF THE INVENTION

1. Field of the Invention

The present invention relates to a high pressure steamer for continuous wet-heat treatment of a long cloth by subjecting the cloth to such treatments as desizing, scouring, dyeing, felting and weight reduction in a high pressure steamer.

2. Description of the Prior Art

In subjecting a long cloth produced commercially to such treatments as desizing, scouring, dyeing, felting and weight reduction under wet-heat (hereinafter simply called wet-heat treatment), a Perble Range (commercial name) and a high pressure steamer, both being developed by the present inventors, have widely been adopted. The outline of the use of Perble Range for the wet-heat treatment of a cloth is to soak a cloth to be treated with a treating solution, and to treat the resultant cloth in a reaction tower for steaming the cloth under the ordinary pressure. The use of a high pressure steamer is to soak a cloth with a treating solution, and to subject the resultant cloth to steaming in the high pressure steamer body. Generally speaking, the use of a high pressure steamer is desirable. The treatment is done at a high temperature under pressure, so that the reaction proceeds speedily, and the treatment is suitable for mass-production. The quality of the product is also superior in many instances.

However, in subjecting a cloth to such treatments as desizing, scouring, bleaching, dyeing, weight reduction by using a high pressure steamer conventionally applied, it is usual to apply a treating solution (such as a caustic alkali solution in pretreatment and weight reduction and a dye solution in dyeing) to a cloth to be treated in a liquid tank provided outside the steamer body or in a liquid seal tank provided at the inlet side seal mechanism of the steamer body, and to subject the cloth thus soaked with a treating solution to steaming in the steamer body. Thus, the application of a treating solution to the cloth is done only one time, so that the amount of the treating solution applied to the cloth is frequently insufficient according to the kind of the cloth and an excellent wet-heat treatment can not be done.

For instance, in fixing a dye printed on a cloth with a prescribed pattern in a high pressure steamer, the interior of the steamer body becomes frequently in a dry heat state due to the deficiency of water vapor, and it requires a long time (for instance 2 to 3 minutes) until the fixing of the dye is completed, preventing a high speed and excellent dyeing. Further, while an increasing amount of multi-fiber cloths has been produced in recent years to meet with the demand of high class cloth, it is necessary thereby that the atmosphere is in a sufficient wet-heat condition, and a satisfactory treatment cannot be expected in the conventional wet-heat treating method.

Under such circumstances, the present inventors have recently proposed a high pressure steamer for continuous wet-heat treatment of a cloth, for which apparatus providing a plurality of boiling tanks (liquid applying tanks) in the steamer body for subjecting a cloth passing through the steamer body to boiling and steaming alternately and repeatedly. However, in this apparatus, since water at the ordinary temperature is supplied successively from outside of the steamer body as a means for supplying water to each of the boiling tanks provided in the steamer body, a large quantity of water is necessitated, and further, a large amount of steam is condensed in the steamer body for the reason that the water supplied from outside of the steamer body is at low temperature, thus decreasing the temperature in the steamer body and consuming heat energy. The apparatus proposed was not yet satisfactory.

SUMMARY OF THE INVENTION

Accordingly, the object of the present invention is to improve the above-mentioned apparatus for continuous wet-heat treament of a cloth in a high pressure steamer proposed by the present inventors.

The principle of the present inventive apparatus is to utilize waste water in the slow cooling tank provided at the outlet side seal mechanism of a steamer body repeatedly for the use of boiling water in the liquid applying tanks and prewashing tanks provided in the steamer body by heating the water with the use of a heat exchanger. Thus, the wet-heat treatment of a cloth can be done continuously by sparing water resource and heat energy to give an excellent and uniform product.

Under certain circumstances, cooling water in the water cooling tank provided at the seal rubber rollers of the inlet side seal mechanism can be utilized for reuse together with the cooling water in the slow cooling tank. The treating solution in the liquid seal tank of the inlet side seal mechanism can separately be utilized for the further application of the treating solution to the cloth in the steamer body.

Moreover, a cloth may be treated to form irregularity in its tone intentionally by supplying the reused water at high temperature locally to the cloth in the steamer body with the use of nozzles.

BRIEF DESCRIPTION OF THE DRAWINGS

The drawings are the sectional side views of the examples of the present invention apparatus for wet-heat treating a cloth continuously to explain the constructions thereof.

DETAILED DESCRIPTION OF THE PREFERRED EMBODIMENTS

Preferred embodiments of the present inventive apparatus for wet-heat treating a cloth continuously will be described in detail in the following with references to the drawings showing the examples of the inventive apparatus.

EXAMPLE 1

Figure 1:
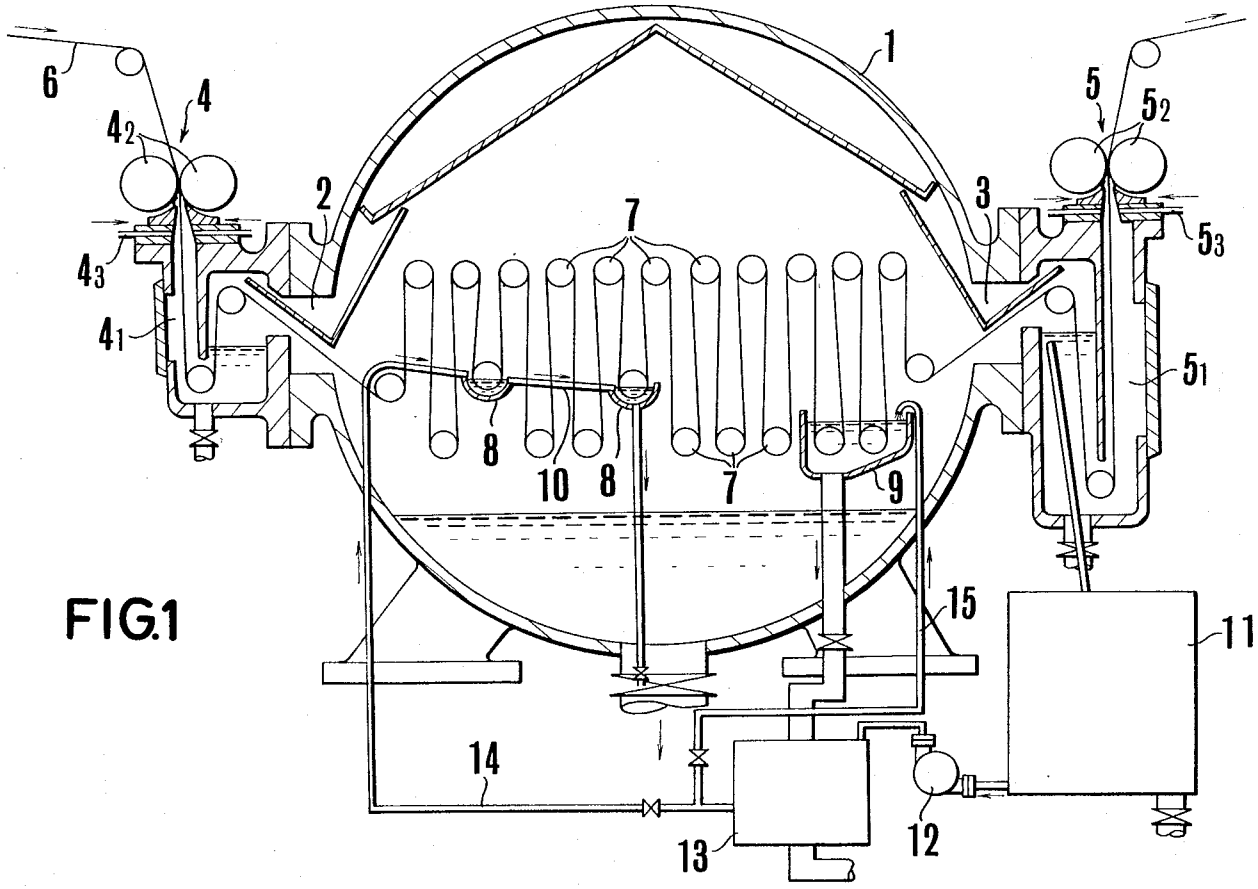
FIG. 1 is for Example 1,
FIG. 2 for Example 2,
FIG. 3 for Example 3 and
FIG. 4 for Example 4.

FIG. 1 shows Example 1 of the present inventive apparatus. In FIG. 1, numeral 1 denotes a high pressure steamer body for wet-heat treating a cloth continuously. The steamer body is provided with a cloth inlet 2 and a cloth outlet 3, respectively having an inlet side seal mechanism 4 and an outlet side seal mechanism 5, for transporting a cloth to be treated continuously through the steamer body 1 while maintaining the interior thereof with high temperature and pressure wet-heat, for instance, at a temperature in the range of from 100° to 160° C.

The inlet side seal mechanism 4 comprises a nearly J-shaped liquid seal tank $4_1$ for sealing the steamer body with a treating solution, a pair of seal rubber rollers $4_2$ for sealing the upper opening of the liquid seal tank $4_1$ and a liquid supply pipe $4_3$ positioned above the liquid seal tank $4_1$ for supplying a treating solution to the liquid seal tank. The outlet side seal mechanism 5 comprises a slow cooling tank $5_1$ for introducing cooling water therein, a pair of seal rubber rollers $5_2$ for sealing the upper opening of the slow cooling tank $5_1$, and a cooling water supply pipe $5_3$ positioned above the cooling water tank $5_1$ for supplying cooling water to the slow cooling tank.

In the interior of the steamer body 1, a plurality of guide rollers 7 are provided up and down for transporting a cloth 6 to be treated up and down zigzag forming snaky undulations through the steamer body 1. At the lower part of the steamer body 1, a plurality of liquid applying tanks 8 and a prewashing tank 9 are provided for soaking the cloth transported by means of the guide rollers 7 repeatedly with hot water. 10 is a liquid supply pipe for supplying a liquor overflowing from a liquid applying tank 8 to another liquid applying tank 8 positioned at the lower stage.

Numeral 11 denotes a filter for filtering waste water exhausted from the slow cooling tank $5_1$, and the filtrate (cleansed water) from the filter 11 is supplied through a pump 12 to a heat exchanger 13 for heating the cleansed water with the aid of high temperature liquor coming out of the prewashing tank 9. The hot cleansed water is supplied to the first member of the liquid applying tanks 8 and the prewashing tank 9 respectively by means of a conduit 14 and a conduit 15.

As a filter 11 in the above, anything may be employed so long as the filter 11 is able to separate such impurities as waste pieces of thread contained in the waste water exhausted from the slow cooling tank $5_1$ continuously. For this purpose, there are the apparatuses disclosed by the present inventors in Japanese Patent Application Nos. 54-164573, 54-164574 and 57-88471.

The construction of Example 1 of the present inventive apparatus is as described above. Now, its function will be stated in the following paragraphs.

In the first place, the steamer body 1 is saturated with high temperature and pressure steam at a temperature, for instance, 160° C., the liquid seal tank $4_1$ of the inlet side seal mechanism 4 is filled with a treating solution supplied from the liquid supply pipe $4_3$, and cooling water is supplied from the liquid supply pipe $5_3$ into the slow cooling tank $5_1$. Then, a long cloth 6 is supplied through the inlet side seal mechanism 4 into the steamer body 1 for subjecting the cloth 6 to the treatment (such as pretreatment including desizing, scouring and bleaching as well as weight reduction, dyeing and felting) continuously. In the meanwhile, cooling water in the slow cooling tank $5_1$ is heated to about 50° C., filtered to remove impurities by the filter 11 and sent to the heat exchanger 13 by means of the pump 12. In the heat exchanger 13, cleansed water is heated with high temperature waste liquor at about 160° C. under pressure coming from the prewashing tank 9 to a temperature nearly equal to 160° C. and supplied to the liquid applying tanks 8 and the prewashing tank 9 by means of the conduits 14 and 15.

The cloth 6 passing through the steamer body 1 is boiled intermittently and repeatedly in the liquid applying tanks 8 and finally prewashed in the prewashing tank 9, so that wet-heat treatment of a cloth 6 can be done effectively in the steamer body 1 to give an excellent and uniform product.

Moreover, in this example, waste water discharged from the slow cooling tank $5_1$ is cleansed and heated for reuse in the steamer body 1, so that water resource and heat energy are spared and the interior of the steamer body 1 can be maintained with wet-heat effectively and efficiently.

EXAMPLE 2

Figure 2:
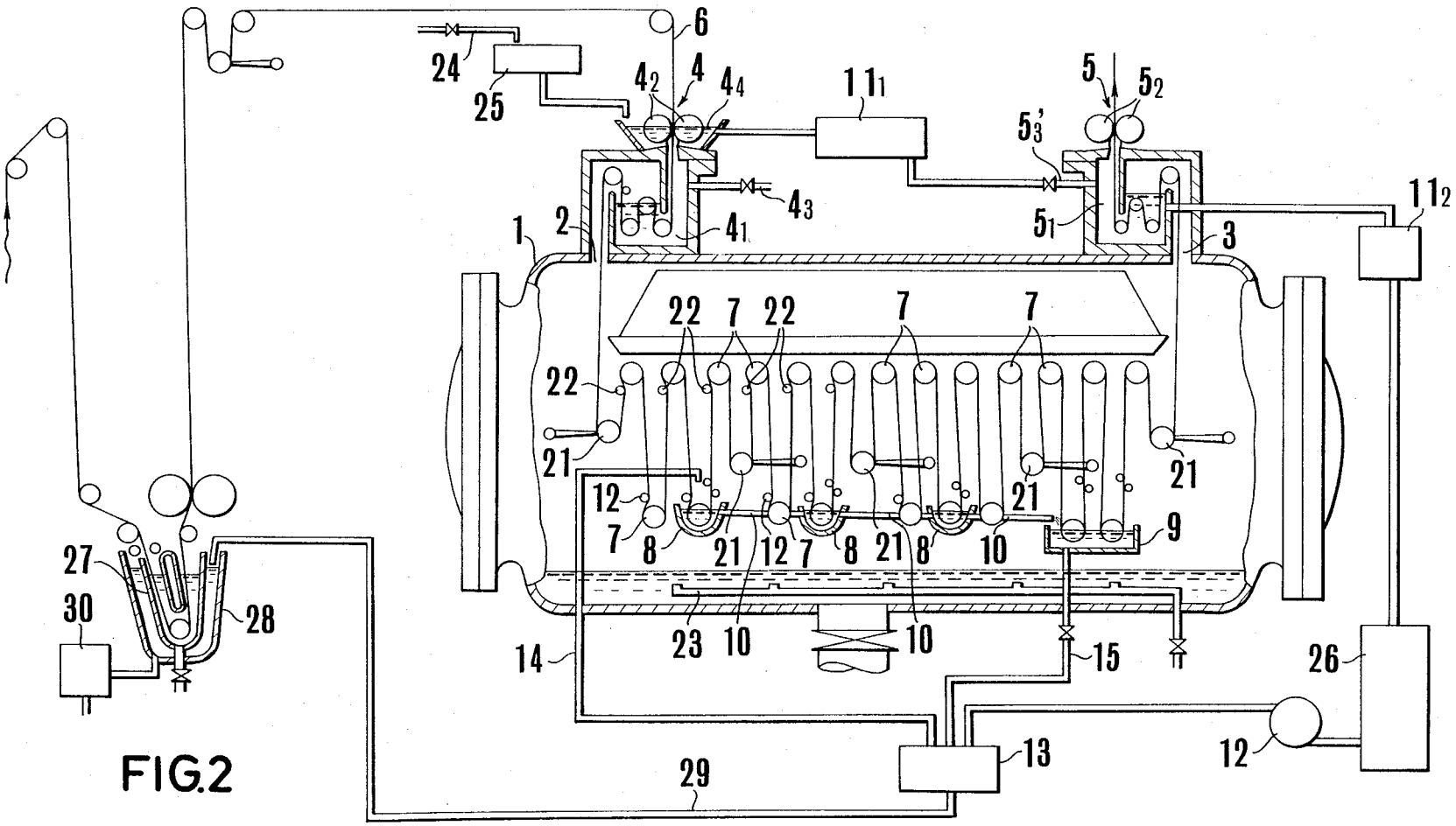

FIG. 2 shows Example 2 of the present inventive apparatus. The construction of the main parts of the apparatus in this example is the same as in Example 1 together with the notations thereof. Example 2 shows how to cool and cleanse the seal rubber rollers $4_2$ of the inlet side seal mechanism 4 with water, and to utilize said cooling water for reuse as the cooling water in the slow cooling tank $5_1$ of the outlet side seal mechanism 5.

In FIG. 2, $4_4$ denotes a water cooling tank covering the seal rubber rollers $4_2$. Numeral 24 denotes a water supply pipe and 25 denotes a water tank, both for supplying water to the water cooling tank $4_4$ with a constant rate. Numeral $11_1$ denotes a filter to cleanse the water coming out of the water cooling tank $4_4$, and thus cleansed water is supplied via a pipe $5'_3$ to the slow cooling tank $5_1$ of the outlet side seal mechanism 5 for further use. Numeral $11_2$ denotes another filter, and 26 denotes a water tank for storing the water from the filter $11_2$ temporarily. In the steamer body 1, 21 denotes tension control rollers and 22 denotes fixed friction members, both being provided in addition to the guide rollers 7 for ensuring the smooth movement of the cloth 6 through the steamer body 1.

Numeral 27 denotes a treating solution tank (saturator) provided outside the steamer body 1, 28 denotes a water heating tank surrounding the treating solution tank 27, and 29 denotes a conduit connecting the filter 13 and the water heating tank 28. Numeral 30 denotes a filter for cleansing the water coming out of the water heating tank 28 for applying the water for further use such as washing water in another washing apparatus not shown in FIG. 2.

In wet-heat treating a cloth continuously by using the apparatus in this example, a cloth 6 to be treated is soaked with a treating solution in the treating solution tank 27 outside of the steamer body 1. Water coming from the conduit 29 has been heated nearly to the boiling point thereof, so that the treating solution to be applied to the cloth 6 can be heated to a tolerably high temperature. The cloth 6 thus soaked with a treating solution is supplied into the steamer body 1, and the temperature of the cloth 6 containing the treating solution is about 50° C. at the seal rubber rollers $4_2$. In the steamer body 1, the liquid seal tank $4_1$ of the inlet side seal mechanism 4 may be filled either with the treating solution as in the treating solution tank 27 or with water under circumstances.

On the other hand, water is supplied from the water supply pipe 24 via the water tank 25 into the water cooling tank $4_4$ for cooling and cleansing the seal rubber rollers $4_2$ rotating continuously. Such impurities as waste yarns are washed out from the seal rubber rollers $4_2$ and the cooling water is cooled to about 35° C. The cooling water further contains a small amount of the treating solution due to the squeezing of the cloth 6 with the seal rubber rollers $4_2$. Thus heated water is cleansed by passing through the filter $11_1$ and supplied into the slow cooling tank $5_1$ for further use. The waste water from the slow cooling tank $5_1$ is filtered again by passing through the filter $11_2$, stored temporarily in the water tank 26 and supplied into the heat exchanger 13.

Further use of the apparatus in this example is the same as in Example 1.

EXAMPLE 3

Figure 3:
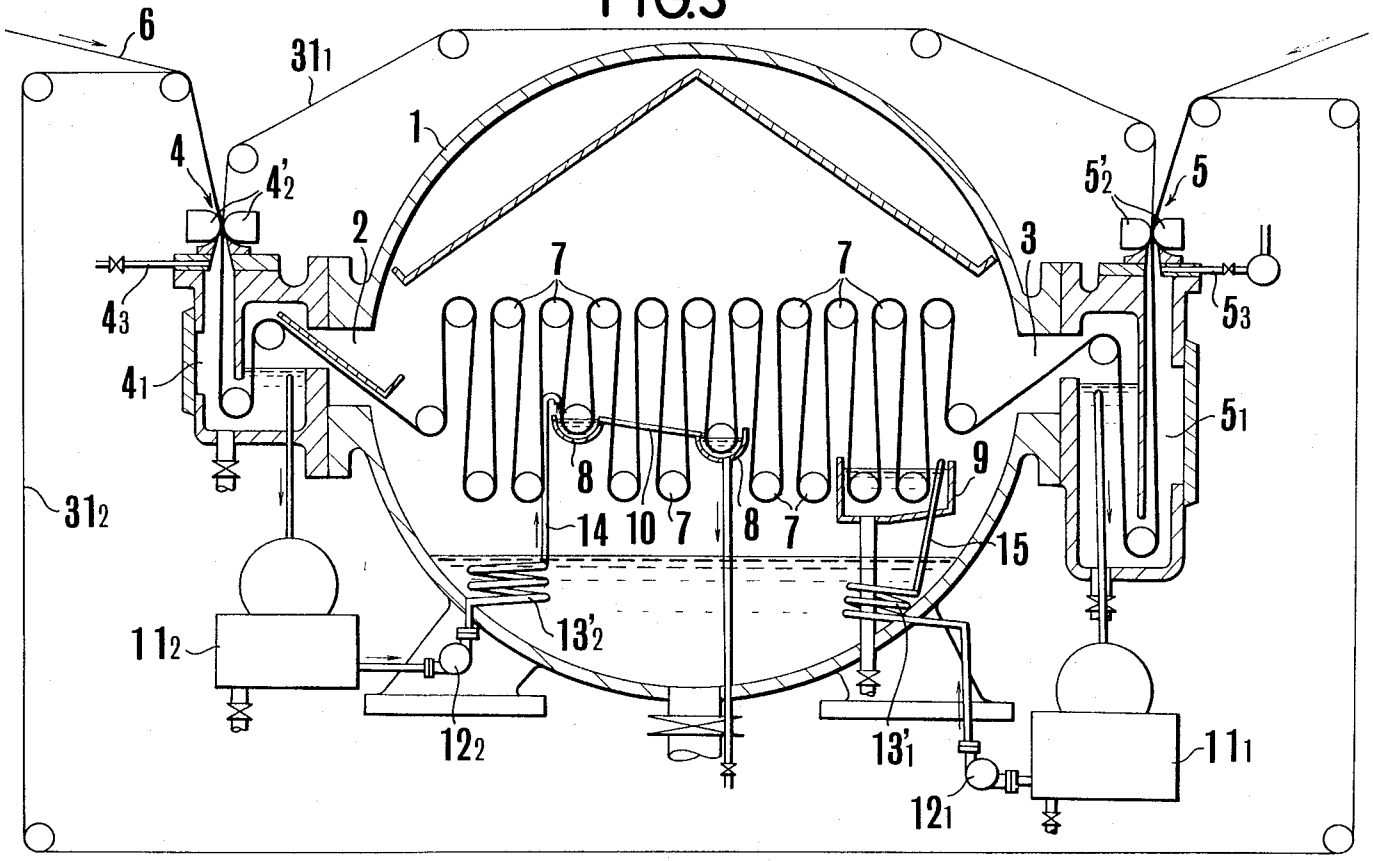

FIG. 3 shows Example 3 of the present inventive apparatus. The construction of the apparatus in this example is, unless otherwise stated, the same as in Example 1 together with the notations thereof. Example 3 shows how to utilize a part of the treating solution in the liquid seal tank $4_1$ for soaking the cloth 6 therewith repeatedly in the steamer body 1. What are specific elements in this example are as follows.

In FIG. 3, $4'_2$ and $5'_2$ are respectively a pair of lip seals for sealing the cloth inlet 2 and the cloth outlet 3 of the steamer body 1 instead of using a pair of rubber seal rollers. Numeral $11_1$ denotes a filter for filtering the waste water coming from the slow cooling tank $5_1$, $12_1$ denotes a pump and $13'_1$ denotes a hose to serve as a heat exchanger. Numeral $11_2$ denotes another filter for filtering the treating solution coming from the liquid seal tank $4_1$, $12_2$ denotes a pump, and $13'_2$ denotes a hose to serve as a heat exchanger. Numerals $31_1$ and $31_2$ denotes guide cloths for transporting a cloth 6 smoothly through the steamer body 1 by putting the cloth 6 therebetween. The guide cloths $31_1$ and $32_2$ are provided because the lip seals $4'_2$ and $5'_2$ are used for sealing the steamer body 1 and not for also guiding the cloth 6 in this example.

In this example, particularly, a part of the treating solution overflowing from the liquid seal tank $4_1$ is filtered by passing the solution through the filter $11_2$ for removing impurities coming from the cloth 6, heated and supplied successively to the liquid applying tanks 8, where the cloth 6 is soaked with the treating solution repeatedly in the steamer body 1. The cloth 6 is soaked with the treating solution and steamed alternately and repeatedly, so that the treating solution permeates up to the core part of the cloth 6 and the wet-heat treatment of the cloth 6 can be done more effectively to give an excellent and uniform product. Since the treating solution in the liquid applying tanks 8 are absorbed by the cloth 6 successively, the concentration of the treating solution exhausted from the last member of the liquid applying tanks 8 is very low, and therefore, the wastefullness of the treating solution and the problem of public pollution can be prevented satisfactorily.

EXAMPLE 4

Figure 4:
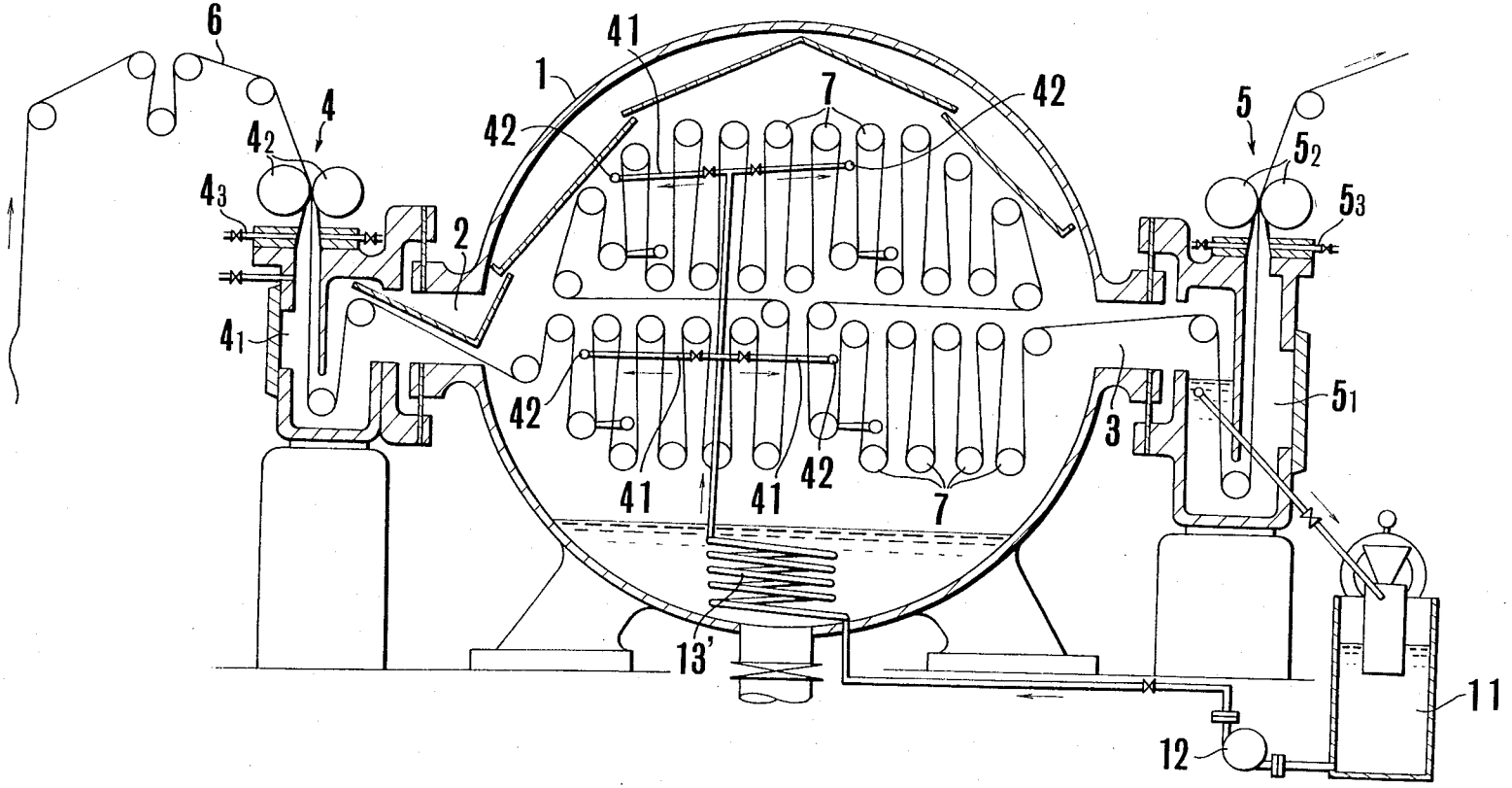

Example 4 of the present inventive apparatus in FIG. 4 shows how to apply a treating solution to a part of the cloth 6 locally in the steamer body 1 for the purpose of treating the cloth 6 irregularly. It is of course that the treatment of a cloth 6 must be done uniformly. However, in recent years, it is desired to subject a cloth 6 to such treatments as pretreatment, weight reduction and dyeing irregularly due to the demand of a cloth 6 having irregularity in its tone. This example of the apparatus intended to answer said demand.

As shown in FIG. 4, a plurality of liquid applying tanks 8 and prewashing tanks 9 in the preceding examples are substituted with a plurality of nozzles 42 together with conduits 41. The nozzles 42 are arranged so that the cloth 6 receives hot water locally.

In applying hot water coming from the slow cooling tank $5_1$ locally to the cloth 6 by means of a plurality of nozzles 42 in this example, the treating solution adhering to the cloth reacts with the cloth 6 speedily and excellently at the position where the temperature of the cloth 6 is elevated locally due to the jetting of hot water, while the parts where hot water is not applied remain unreacted, thus the treatment becomes uneven for producing a cloth 6 having irregularity in its tone. Under circumstances, the treating solution in the liquid seal tank $4_1$ may be utilized for causing irregularity to the cloth 6.

As described above in detail, the present inventive apparatus is excellent to subject a long cloth 6 to such treatments as pretreatment, weight reduction, dyeing and felting continuously. The product obtained is superior and uniform, and under circumstances, a product having irregularity may be produced intentionally.

Moreover, the waste water from the slow cooling tank 5 is reused for sparing the water resource effectively, and the water to be supplied into the steamer body 1 is heated by utilizing the waste heat of the steamer body 1 for sparing heat energy. Thus, the use of the present inventive apparatus is quite economical.

What we claim:

1. A high pressure steamer for continuous wet-heat treatment of a cloth comprising:

a steamer body, an inlet and an outlet for taking in and out a cloth continuously through the steamer body, said cloth inlet having an inlet side seal mechanism provided with a liquid seal tank and said cloth outlet having an outlet side seal mechanism provided with a slow cooling tank, a plurality of liquid applying tanks and prewashing tanks for boiling the cloth passing through the steamer body, a filter for cleansing waste water exhausted from the slow cooling tank, a heat exchanger for heating the cleansed water with the use of high temperature waste liquor from the prewashing tanks, and conduits for supplying the heated water to the liquid applying tanks and prewashing tanks.

2. A high pressure steamer according to claim 1, which further comprises:

a pair of seal rubber rollers in the inlet side mechanism, a water cooling tank covering the pair of seal rubber rollers, a filter connecting the water cooling tank to the slow cooling tank in the outlet side seal mechanism so as to utilize the water in the water cooling tank for reuse.

3. A high pressure steamer according to claim 1, which further comprises:

another series of a filter, heat exchanger and conduit means for supplying a part of the treating solution in the liquid seal tank of the inlet side seal mechanism to the liquid applying tanks.

* * * * *